US011363870B1

(12) United States Patent
Cohen

(10) Patent No.: US 11,363,870 B1
(45) Date of Patent: Jun. 21, 2022

(54) CONTOURED PRODUCT FOR ABSORBING MOISTURE

(71) Applicant: CROWN AFFAIR, INC., New York, NY (US)

(72) Inventor: Daniel Cohen, New York, NY (US)

(73) Assignee: CROWN AFFAIR, INC., New York, NY (US)

( * ) Notice: Subject to any disclaimer, the term of this patent is extended or adjusted under 35 U.S.C. 154(b) by 0 days.

(21) Appl. No.: 16/773,683

(22) Filed: Jan. 27, 2020

(51) Int. Cl.
*A45D 20/00* (2006.01)
*A42B 1/041* (2021.01)

(52) U.S. Cl.
CPC ..... *A45D 20/00* (2013.01); *A42B 1/041* (2013.01)

(58) Field of Classification Search
CPC ..... A45D 20/00; A42B 1/041
See application file for complete search history.

(56) References Cited

U.S. PATENT DOCUMENTS 2,698,944 A * 1/1955 Ramsby ..... A42B 1/041 2/174
5,336,543 A * 8/1994 Pyle ..... A47K 10/02 139/383 R
5,490,528 A * 2/1996 Day ..... A42B 1/04 132/200
6,427,251 B1 * 8/2002 Leach ..... A42B 1/041 2/174
9,326,559 B2 * 5/2016 Roban ..... A42B 1/048
9,591,882 B2 * 3/2017 Duffin ..... A42B 1/06
10,172,404 B2 * 1/2019 Elharar ..... A42B 1/041
11,051,600 B2 * 7/2021 McKay ..... A45D 20/00
2002/0144701 A1 * 10/2002 Leslie ..... A45D 44/08 132/212
2008/0229479 A1 * 9/2008 Butterly ..... A45D 19/18 2/174
2010/0043122 A1 * 2/2010 Leftenant ..... A42B 1/041 2/204
2010/0299807 A1 * 12/2010 Saito ..... A42B 1/041 2/174
2015/0320180 A1 * 11/2015 McGuire ..... A41D 3/08 2/50
2015/0366329 A1 * 12/2015 Manning ..... A45D 8/40 2/50
2016/0088979 A1 * 3/2016 Johnson ..... A42B 1/041 34/96
2016/0198830 A1 * 7/2016 Tussey ..... A45D 8/40 2/183
2018/0110317 A1 * 4/2018 Girod ..... A62B 17/006
2018/0235411 A1 * 8/2018 Guerra-Sievers ..... A42B 1/00
2019/0037944 A1 * 2/2019 Tussey ..... A42B 1/041
2020/0008551 A1 * 1/2020 Clifton ..... A45D 20/02
2020/0121052 A1 * 4/2020 McKay ..... A42B 1/041
2021/0007559 A1 * 1/2021 DiVirgilio ..... A47K 10/02

* cited by examiner

*Primary Examiner* — Richale L Quinn
(74) *Attorney, Agent, or Firm* — Foley & Lardner LLP

(57) ABSTRACT

A contourable product for absorbing moisture includes a main sheet comprising an absorbent material. A number of sides of the main sheet is more than four, with the main sheet defined by a polygonal shape. The main sheet is movable between an unwrapped position and a wrapped position. In the unwrapped position, the main sheet is completely unfolded and substantially flat. In the wrapped position, the main sheet is contoured to secure to and wrap around a human head and extend around head hair of the human head.

21 Claims, 9 Drawing Sheets

CONTOURED PRODUCT FOR ABSORBING MOISTURE

FIELD

The present application relates generally to contourable products for drying hair.

BACKGROUND

Conventional, rectangular towels may be used to dry wet hair. For example, users may wrap the towel around their head and hair to dry their hair in a passive manner.

SUMMARY

With conventional products, it can be difficult for users to securely wrap conventional towels around their heads and twist the towels around their hair, and the towels may easily fall off their heads. In the present disclosure, various embodiments provide for a contourable product for absorbing moisture that includes a main sheet comprising an absorbent material. A number of sides of the main sheet is more than four, with the main sheet defined by a polygonal shape. The main sheet is movable between an unwrapped position and a wrapped position. In the unwrapped position, the main sheet is completely unfolded and substantially flat. In the wrapped position, the main sheet is contoured to secure to and wrap around a human head and extend around head hair of the human head.

These and other features (including, but not limited to, retaining features and/or other features), together with the organization and manner of operation thereof, will become apparent from the following detailed description when taken in conjunction with the accompanying drawings, wherein like elements have like numerals throughout the drawings described below.

DETAILED DESCRIPTION

Figure 1A:
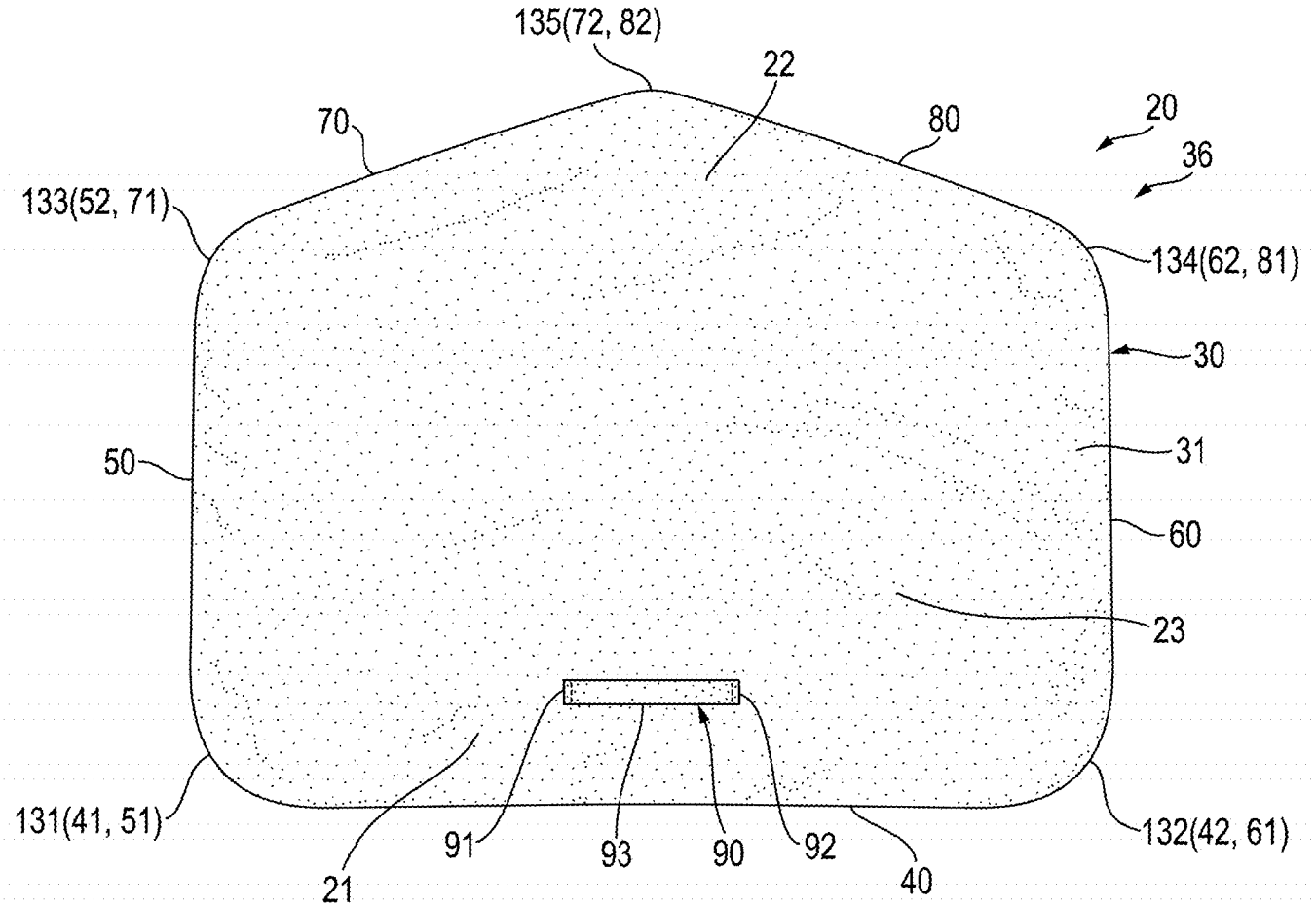
FIG. 1A is a top view of a contourable product according to one embodiment in an unwrapped position.

Referring to the figures generally, various embodiments disclosed herein relate to a contourable product that is configured to dry wet hair and easily and securely wrap around a user's head.

As shown in the figures, a contourable product 20 (e.g., a towel) is described herein that is configured to dry a user's wet hair (in particular head hair of human head 10) by absorbing moisture (e.g., water). As described further herein, the contourable product 20 is configured to easily and securely wrap around the head hair 11 and the human head 10.

As shown in FIGS. 1A-2C, the contourable product 20 comprises a main sheet 30 that is movable between an unwrapped position 36 and a wrapped position 38. The unwrapped position 36 refers to when the main sheet 30 is completely unfolded and substantially flat. The wrapped position 38 refers to when the main sheet 30 is contoured (e.g., bent, shaped, curved, etc.) to conform around the human head 10 to secure to and wrap around the human head and to wrap and extend around at least a portion of the head hair 11 of the human head 10. In the wrapped position 38, at least a portion of the main sheet 30 is configured to twist around at least a portion of itself and completely around the human head 10 and at least a portion the length of its head hair 11, thereby creating a twist bundle (e.g., the tubular roll such as an elongated cylindrical roll) of the hair 11 and a portion of the contourable product 20, where at least a portion the contourable product 20 is wrapped around at least a portion of the length of the hair 11.

In the unwrapped position 36, the main sheet 30 has a planar, substantially two-dimensional shape (notwithstanding the thickness of the contourable product 20). The main sheet 30 is substantially flat and has a thickness (height) which may be smaller than the length and width of the contourable product 20. In wrapped position 38, the main sheet 30 is contoured into a three-dimensional shape to fit around the human head 10 and its hair 11. For example, in at least one embodiment, the length may be approximately 32.5 inches (in.), the width may be approximately 39.25 in., and the thickness approximately 0.0625 in. However, it is understood that the main sheet 30 can be contoured and/or folded into a variety of different positions in between the unwrapped position 36 and the wrapped position 38 and that the length, width and thickness may have different dimensions from the exemplary dimensions noted above.

Figure 1B:
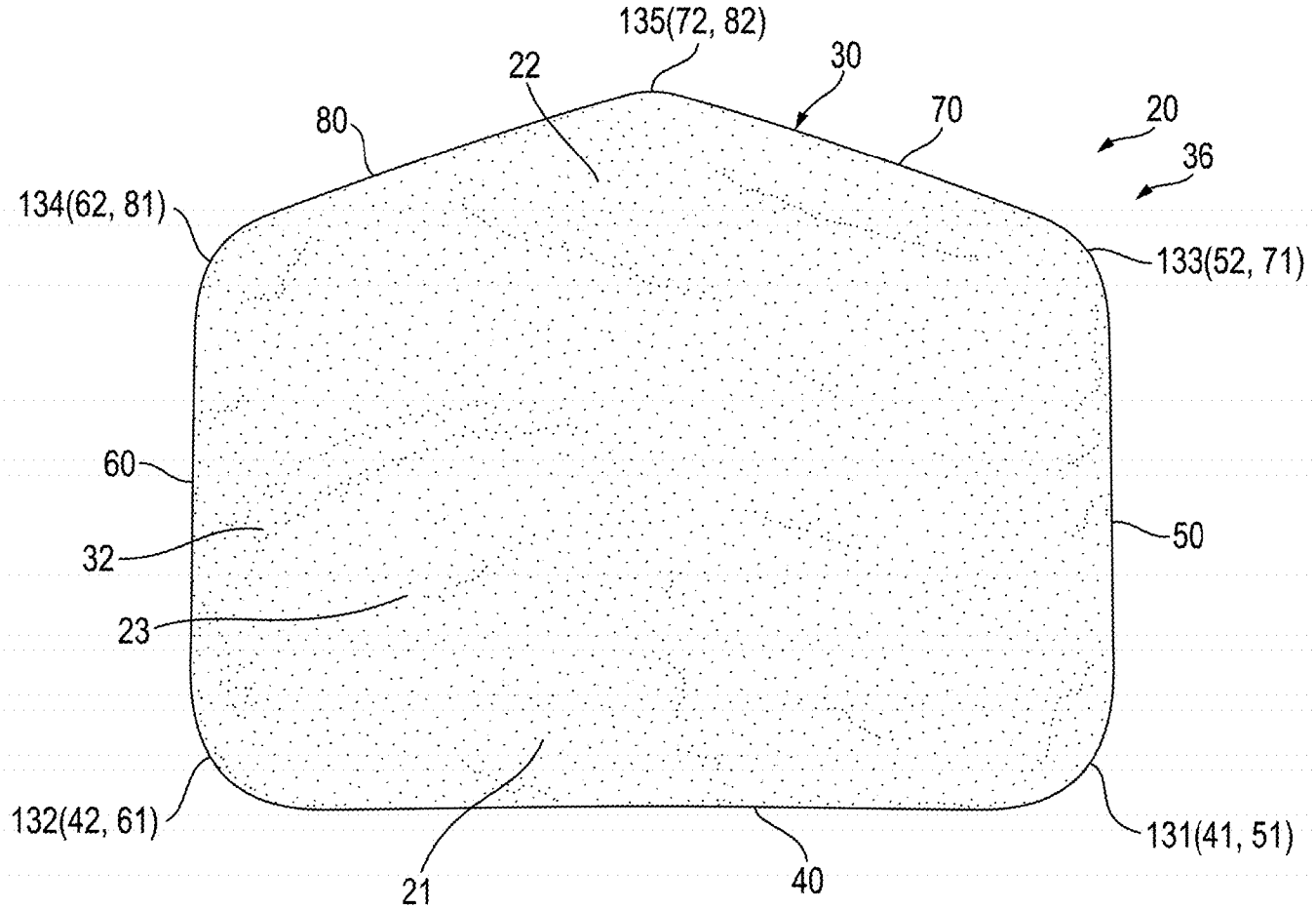
FIG. 1B is a bottom view of the contourable product of FIG. 1A.
Figure 6B:
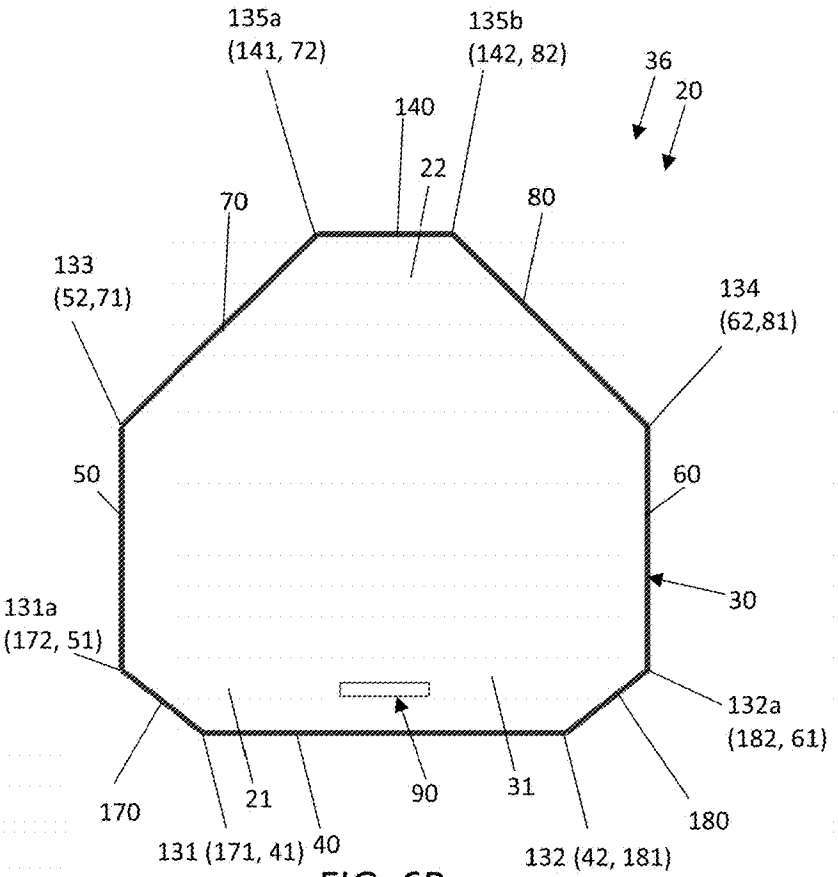
FIG. 6B is a top view of an eight-sided alternative embodiment of the contourable product.
Figure 6A:
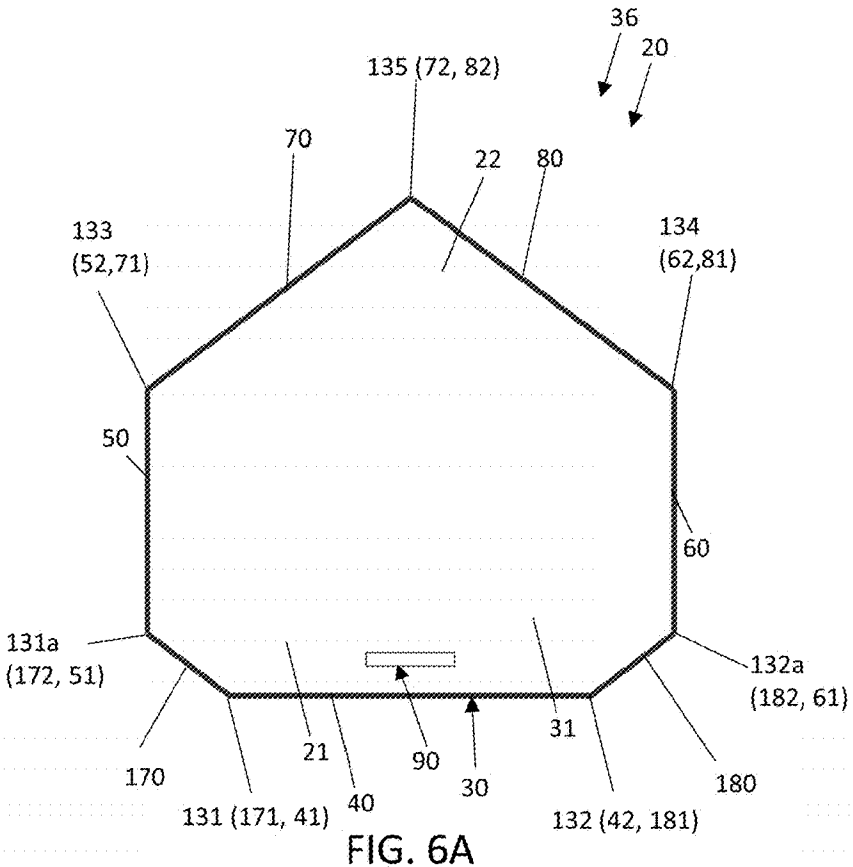
FIG. 6A is a top view of a seven-sided alternative embodiment of the contourable product.

In the unwrapped position 36, the main sheet 30 has a polygonal shape that is not rectangular. In particular, the substantially flat, two-dimensional shape of the main sheet 30 in the unwrapped position 36 forms or defines the non-rectangular, polygonal shape. According to various embodiments, the main sheet 30 may include any number of outer edges to create the non-rectangular, polygonal shape. For example, according to one embodiment as shown in FIGS. 1A-1B and as described further herein, the main sheet 30 has five outer edges that define the polygonal shape, so as to have a pentagonal shape. The pentagonal shape defines the main sheet 30 in the unwrapped position 36. The pentagonal shape is one example of the polygonal configurations that the contourable product 20 may be formed in, accordingly to at least one embodiment. In particular, the number of sides n of the polygon (of the main sheet 30)

defining the perimeter of the contourable product 20 may be any number that is greater than four (n>4). For example, the polygonal shape of the contourable product 20 is a seven-sided polygonal or heptagonal (septagonal) shape, according to another embodiment as shown in FIG. 6A. Alternatively, the polygonal shape of the contourable product 20 is an eight-sided polygonal or octagonal shape, according to another embodiment as shown in FIG. 6B. Alternatively, the polygonal shape of the contourable product 20 is a six-sided polygonal or hexagonal shape, according to another embodiment as shown in FIG. 7C.

This non-rectangular, polygonal shape of the main sheet 30 allows the contourable product 20 to more securely and/or comfortably and/or ergonomically conform to the shape of and attach to the human head 10 (and its hair 11) and wrap around the head hair 11 compared to conventional quadrilateral (e.g., rectangular) towels. For example, if a user wraps a conventional, rectangular towel 200 (as shown in FIGS. 7A-7C) around a portion of their head and twists the rectangular towel around their head hair, excess material of the rectangular towel 200 may impact how securely the towel fits the head and/or user comfort and/or ergonomics. For comparison, the rectangular towel 200 and various embodiments of the contourable product 20 are overlaid with each other in FIGS. 7A-7C to show regions of excess material of the rectangular towel 200 (which are areas of negative space not present in the contourable product 20, as described further herein). Two pairs of regions of excess material, in particular, affect the fit, comfort, and/or ergonomics of the rectangular towel 200. These regions include two distal excess regions (comprising an excess distal-left or first distal area or region 201 and an excess distal-right or second distal area or region 202), as well as two proximal excess regions (comprising an excess proximal-left or third proximal area or region 203 and an excess proximal-right or fourth proximal area or region 204). The excess regions 201, 202, 203, 204 may be substantially triangular and correspond to areas along the four corners of the rectangular towel 200.

Figures 7A, 7B, 7C:
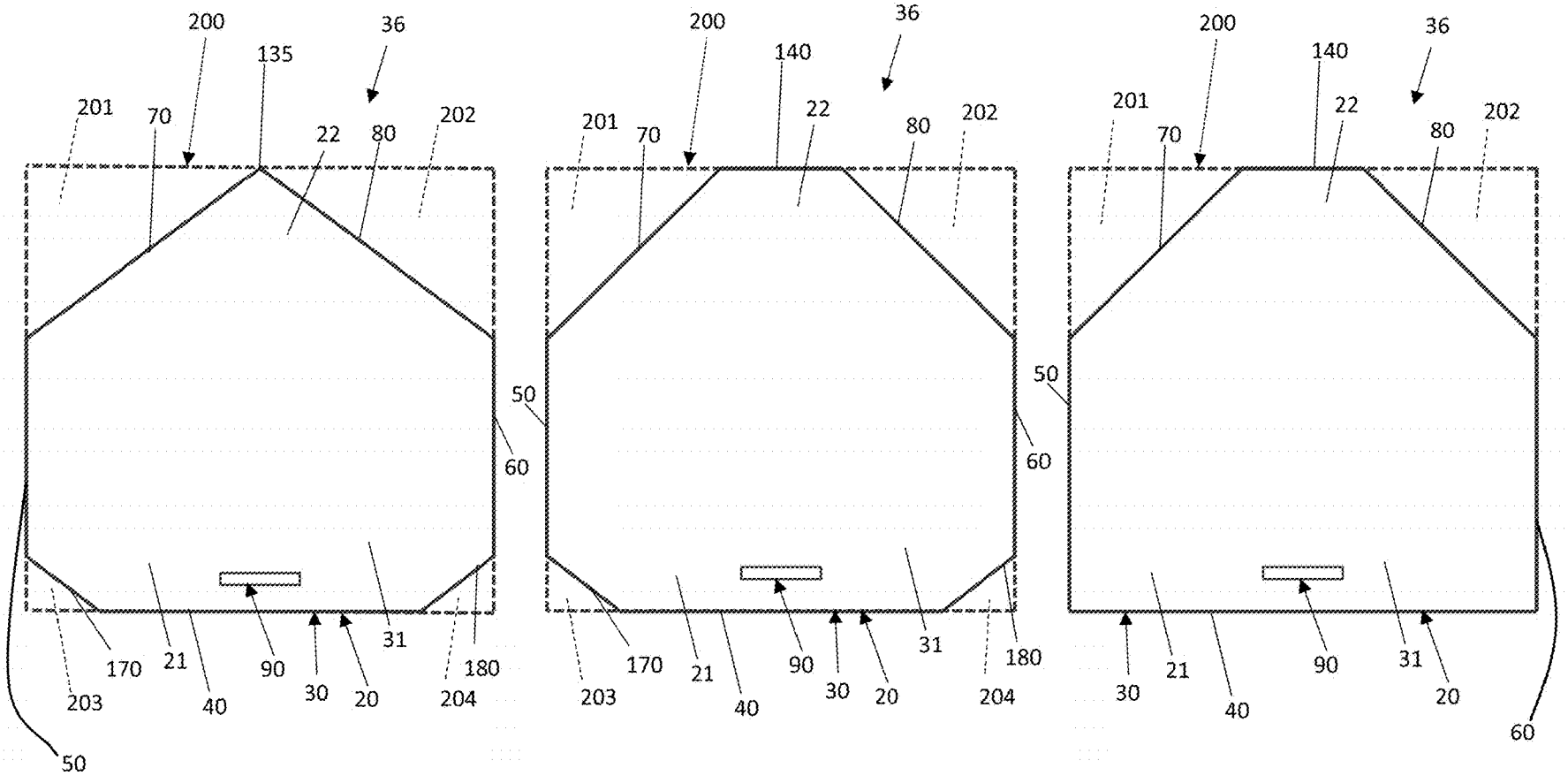
FIG. 7A is a top view of the contourable product of FIG. 6A shown with negative regions created by subtraction from a quadrilateral geometry.
FIG. 7B is a top view of the contourable product of FIG. 6B shown with negative regions created by subtraction from a quadrilateral geometry.
FIG. 7C is a top view of a six-sided alternative embodiment of the contourable shown with negative regions created by subtraction from a quadrilateral geometry.

As shown in FIGS. 7A-7B, each of the proximal excess regions 203, 204 extends along a portion of the back edge and a portion of one side edge of the rectangular towel 200 (which correspond to the back edge 40 and one of the side edges 50, 60, respectively, of the contourable product 20). The inside edges of the proximal excess regions 203, 204 are defined by the angled edges 170, 180 (respectively) of the contourable product 20 when overlaid on the rectangular towel 200. The proximal excess regions 203, 204 may contribute to a less securely fitting rectangular towel 200 because, as the user twists the rectangular towel 200 and creates the twist bundle between the towel and the hair, slack may develop along the back edge or the rectangular towel 200 (which corresponds to the back edge 40 of the contourable product 20) which may reduce the friction of the back edge against the head, and in turn loosen the rectangular towel 200. Additionally, the proximal excess regions 203, 204 do not necessary cover the hair within the twist bundle by at least one layer of the rectangular towel 200, yet the material of the proximal excess regions 203, 204 unnecessarily increases the diameter of the twist bundle, which may reduce user comfort and adversely impact ergonomics.

As shown in FIGS. 7A-7C, each of the distal excess regions 201, 202 extends along a portion of the top edge and a portion of one side edge of the rectangular towel 200 (which correspond to the fifth corner 135 or the top edge 140 and one of the side edges 50, 60, respectively, of the contourable product 20). The inside edges of the distal excess regions 201, 202 are defined by the angled edges 70, 80 (respectively) of the contourable product 20 when overlaid on the rectangular towel 200. The distal excess regions 201, 202 may contribute to unnecessary product weight, which impacts user comfort, ergonomics, and/or efficiency. The distal excess regions 201, 202 may also cause the end portion of the rectangular towel 200 (which corresponds to the second end portion 22 of the contourable product 20) to have unnecessary material, which adds to the bulk of the end portion. Such excess material would make it more difficult to loop the twist bundle through the fastener 90, and/or contribute to a less appealing appearance, as the towel edges of the end portion of the rectangular towel 200 do not neatly align with each other. Any or all of these issues may occur with the rectangular towel 200.

The non-rectangular, polygonal shape of the main sheet 30 of the contourable product 20, however, avoids having such excess fabric (in particular the distal excess regions 201, 202 and/or the proximal excess regions 203, 204) by not including some or all of the respective corner regions which correspond to the regions 201, 202, 203, 204, depending on the particular non-rectangular, polygonal shape of the contourable product 20. FIGS. 7A-7C show the various negative spaces (or cut-away material) of the contourable product 20 (which correspond to the various excess regions 201, 202, 203, 204 of the rectangular towel 200). Therefore, with these negative spaces where material is absent, the main sheet 30 allows the user to create a tighter fit of the contourable product 20 on the user's head 10, and/or experience greater comfort and/or superior ergonomics due to a smaller diameter twist bundle. Further, the user may experience greater comfort or superior ergonomics due to lower product weight, and/or more easily fasten the contourable product 20 through the fastener 90, and/or enjoy a more aligned visual appearance compared to conventional, rectangular towel 200. In particular, by virtue of avoiding excess material as described herein, certain embodiments allow the user to dry the user's hair more efficiently than with the rectangular towel 200 at least because the user does not need to manipulate bulky excess material.

The various non-rectangular, polygonal shapes of the contourable product 20 avoid having various combinations of the excess regions 201, 202, 203, 204. For example, with the pentagonal shape and the hexagonal shape, the distal excess regions 201, 202 are absent (as shown in FIG. 7C. With the heptagonal shape and the octagonal shape, both the distal excess regions 201, 202 and the proximal excess regions 203, 204 are absent (as shown in FIGS. 7A-7B). However, it is understood that the contourable product 20 may have a variety of different orientations, relative edge dimensions and angles, and non-rectangular, polygonal shapes that avoid one or more excess regions, or a variety of different combinations of excess regions.

As shown in FIGS. 1A-1B, the contourable product 20 (in particular the main sheet 30) comprises a first end portion 21 and a second end portion 22 that are substantially opposite each other along the length of the main sheet 30 and a middle portion 23 positioned in between the first end portion 21 and the second end portion 22 (along the length of the contourable product 20). As shown in FIG. 2B, in the wrapped position 38, the first end portion 21 is configured to be positioned along and conform or contour to curve substantially parallel to (with a substantially smooth curvature) a back side 12 of the human head 10, and the second end portion 22 is configured to twist around itself and at least a portion of the head hair 11, in particular along at least a portion of the length of the head hair 11.

As shown in FIGS. 1A-1B, the main sheet 30 comprises a first side 31 and a second side 32 that are opposite each other and each have and define the non-rectangular, polygonal shape of the main sheet 30. In the wrapped position 38 and along the first end portion 21 (i.e., along the back side 12 of the head 10), the first side 31 faces away from the human head 10, and the second side 32 extends along and faces toward the human head 10. In the wrapped position 38 and along at least the second end portion 22 (i.e., along the wrapped bundle of the hair 11 and the second end portion 22), the first side 31 faces inwardly toward the wrapped and twisted hair 11, and the second side 32 faces outwardly away from the wrapped and twisted hair 11.

As further shown in FIGS. 1A-1B and FIGS. 6A-7C, the main sheet 30 comprises at least five outer edges 40, 50, 60, 70, 80, 140, 170, and/or 180 that form or define the outer limits of the non-rectangular, polygonal shape of the main sheet 30 about an outer perimeter of the main sheet 30. Each of the edges 40, 50, 60, 70, 80, 140, 170, and/or 180 extend along the thickness of the main sheet 30 between the first side 31 and the second side 32 about the outer perimeter of the main sheet 30.

The at least five edges comprise at least five of a back edge 40, a first side edge 50, a second side edge 60, a first angled edge 70, a second angled edge 80, a top edge 140, a third angled edge 170, and a fourth angled edge 180. The back edge 40 is substantially perpendicular to the first side edge 50 and the second side edge 60. The back edge 40 extends along the width of the main sheet 30. The first side edge 50 and the second side edge 60 are substantially parallel to each other and opposite each other along the width of the main sheet 30. The first side edge 50 and the second side edge 60 extend along at least a portion of the length of the main sheet 30. The first angled edge 70, the second angled edge 80, the third angled edge 170, and the fourth angled edge 180 are at oblique angles to the back edge 40, the first side edge 50, the second side edge 60, and the top edge 140. Due to the angles of the first angled edge 70, the second angled edge 80, the third angled edge 170, and the fourth angled edge 180, the first angled edge 70, the second angled edge 80, the third angled edge 170, and the fourth angled edge 180 each extend along both a portion of the length and a portion of the width of the main sheet 30.

As shown in FIG. 1A, the back edge 40 extends between a first end 41 and a second end 42. The first side edge 50 extends between a first end 51 and a second end 52. The second side edge 60 extends between a first end 61 and a second end 62. The first angled edge 70 extends between a first end 71 and a second end 72. The second angled edge 80 extends between a first end 81 and a second end 82. As shown in FIG. 6B, the top edge 140 extends between a first end 141 and a second end 142. The third angled edge 170 extends between a first end 171 and a second end 172. The fourth angled edge 180 extends between a first end 181 and a second end 182.

The back edge 40 extends between the first end 51 of the first side edge 50 and the first end 61 of the second side edge 60 (as shown in FIG. 1A). Accordingly, the first end 41 of the back edge 40 and the first end 51 of the first side edge 50 form or define a first corner 131 of the main sheet 30, and the second end 42 of the back edge 40 and the first end 61 of the second side edge 60 form or define a second corner 132 of the main sheet 30. The back edge 40 is directly adjacent to and abuts the first side edge 50 and the second side edge 60 at the first corner 131 and the second corner 132, respectively. Alternatively, as shown in FIGS. 6A-6B, when the contourable product 20 includes the third angled edge 170 and the fourth angled edge 180 (which are positioned between the back edge 40 and the first side edge 50 or the second side edge 60, respectively), the back edge 40 extends between the first end 171 of the third angled edge 170 and the first end 181 of the fourth side edge 180. Accordingly, the first end 41 of the back edge 40 and the first end 171 of the third angled edge 170 form or define the first corner 131 of the main sheet 30, and the second end 42 of the back edge 40 and the first end 181 of the fourth angled edge 180 form or define the second corner 132 of the main sheet 30. The back edge 40 is directly adjacent to and abuts the third angled edge 170 and the fourth angled edge 180 at the first corner 131 and the second corner 132, respectively.

The first side edge 50 extends between the first end 41 of the back edge 40 and the first end 71 of the first angled edge 70, as shown in FIG. 1A. Accordingly, the second end 52 of the first side edge 50 and the first end 71 of the first angled edge 70 form or define a third corner 133 of the main sheet 30. The first side edge 50 is directly adjacent to and abuts the back edge 40 and the first angled edge 70 at the first corner 131 and the third corner 133, respectively. Alternatively, as shown in FIGS. 6A-6B, when the contourable product 20 includes the third angled edge 170, the first side edge 50 extends between the second end 172 of the third angled edge 170 and the first end 71 of the first angled edge 70. Accordingly, the first end 51 of the first side edge 50 and the second end 172 of the third angled edge 170 form or define another corner **131*a* of the main sheet 30. In this embodiment, the first side edge 50 is directly adjacent to and abuts the third angled edge 170 and the first angled edge 70 at the corner 131*a* and the third corner 133**, respectively.

The second side edge 60 extends between the second end 42 of the back edge 40 and the first end 81 of the second angled edge 80. Accordingly, the second end 62 of the second side edge 60 and the first end 81 of the second angled edge 80 form or define a fourth corner 134 of the main sheet 30. The second side edge 60 is directly adjacent to and abuts the back edge 40 and the second angled edge 80 at the second corner 132 and the fourth corner 134, respectively. Alternatively, as shown in FIGS. 6A-6B, when the contourable product 20 includes the fourth angled edge 180, the second side edge 60 extends between the second end 182 of the fourth angled edge 180 and the first end 81 of the first angled edge 80. Accordingly, the first end 61 of the second side edge 60 and the second end 182 of the fourth angled edge 180 form or define another corner **132*a* of the main sheet 30. In this embodiment, the second side edge 60 is directly adjacent to and abuts the fourth angled edge 180 and the second angled edge 80 at the corner 132*a* and the fourth corner 134**, respectively.

The first angled edge 70 extends between the second end 52 of the first side edge 50 and the second end 82 of the second angled edge 80, as shown in FIG. 1B. The second angled edge 80 extends between the second end 62 of the second side edge 60 and the second end 72 of the first angled edge 70. Accordingly, the second end 72 of the first angled edge 70 and the second end 82 of the second angled edge 80 form or define a fifth corner 135 of the main sheet 30. The first angled edge 70 is directly adjacent to and abuts the first side edge 50 and the second angled edge 80 at the third corner 133 and the fifth corner 135, respectively. The second angled edge 80 is directly adjacent to and abuts the second side edge 60 and the first angled edge 70 at the fourth corner 134 and the fifth corner 135, respectively. Accordingly, the first and second angled edges 70, 80 are directly adjacent to and abut each other about the perimeter of the main sheet 30. The first angled edge 70 and the second angled edge 80 extend and are positioned between the second end 52 of the first side edge 50 and the second end 62 of the second side edge 60.

Alternatively, as shown in FIG. 6B, when the contourable product 20 includes the top edge 140, the first angled edge 70 extends between the second end 52 of the first side edge 50 and the first end 141 of the top edge 140. The second angled edge 80 extends between the second end 62 of the second side edge 60 and the second end 142 of the top edge. Accordingly, the second end 72 of the first angled edge 70 and the first end 141 of the top edge 140 form or define a corner 135*a* of the main sheet 30, and the second end 82 of the second angled edge 80 and the second end 142 of the top edge 140 form or define a corner 135*b* of the main sheet 30. The first angled edge 70 is directly adjacent to and abuts the first side edge 50 and the top edge 140 at the third corner 133 and the corner 135*a*, respectively. The second angled edge 80 is directly adjacent to and abuts the second side edge 60 and the top edge 140 at the fourth corner 134 and the corner 135*b*, respectively. Accordingly, the top edge 140 is positioned between (and is directly adjacent to and abuts) the second end 72 of the first angled edge 70 and the second end 82 of the second angled edge 80 along the perimeter of the main sheet 30.

Further, in at least some embodiments, each of the corners 131, 131*a*, 132, 133, 134, 135, 135*a*, 135*b* may be curved or rounded to provide a transition area between the respective edges.

Additionally, the back edge 40 is positioned along an opposite end of the main sheet 30 from the first and second angled edges 70, 80 and the top edge 140 along the length of the main sheet 30. Accordingly, the fifth corner 135 (or the corners 135*a*, 135*b*) is disposed opposite the back edge 40 along the length of the main sheet 30. The distance between the fifth corner 135 (or the corners 135*a*, 135*b*) and the back edge 40 defines the total length of the main sheet 30 (and the distance between the first side edge 50 and the second side edge 60 defines the total width of the main sheet 30). Furthermore, the first end portion 21 is positioned along and includes the back edge 40, and the second end portion 22 is positioned along and includes the first and second angled edges 70, 80 and the top edge 140. Accordingly, the first end portion 21 is positioned along and includes the first end 51 of the first side edge 50 and the first end 61 of the second side edge 60. The second end portion 22 is positioned along and includes the second end 52 of the first side edge 50 and the second end 62 of the second side edge 60. In such a configuration, the first and second angled edge 70, 80 (and optionally the top edge 140) together form at least a portion of the second end portion 22 of the main sheet 30.

Figure 2C:
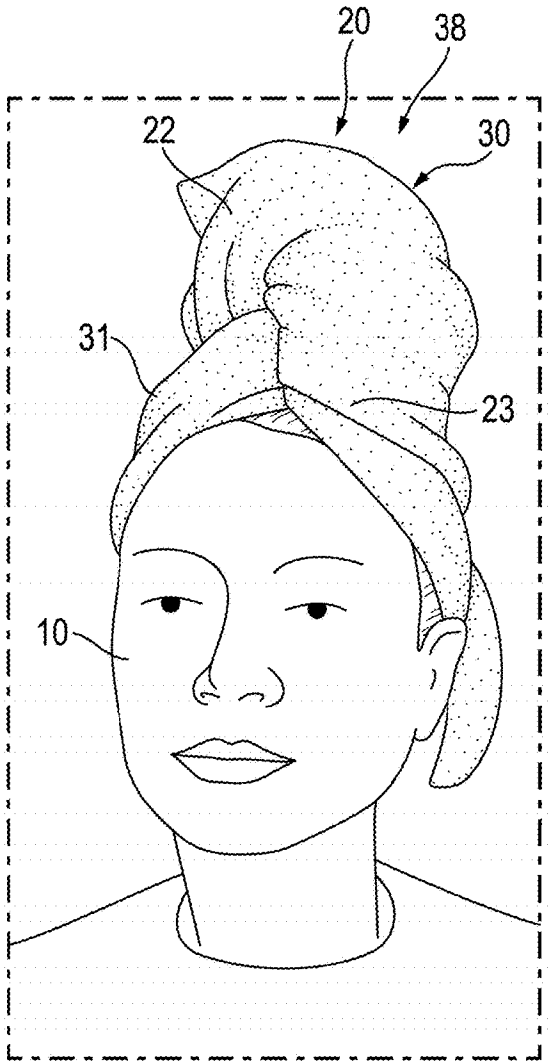
FIG. 2C is a front view of the contourable product of FIG. 1A in the wrapped position.
Figure 2B:
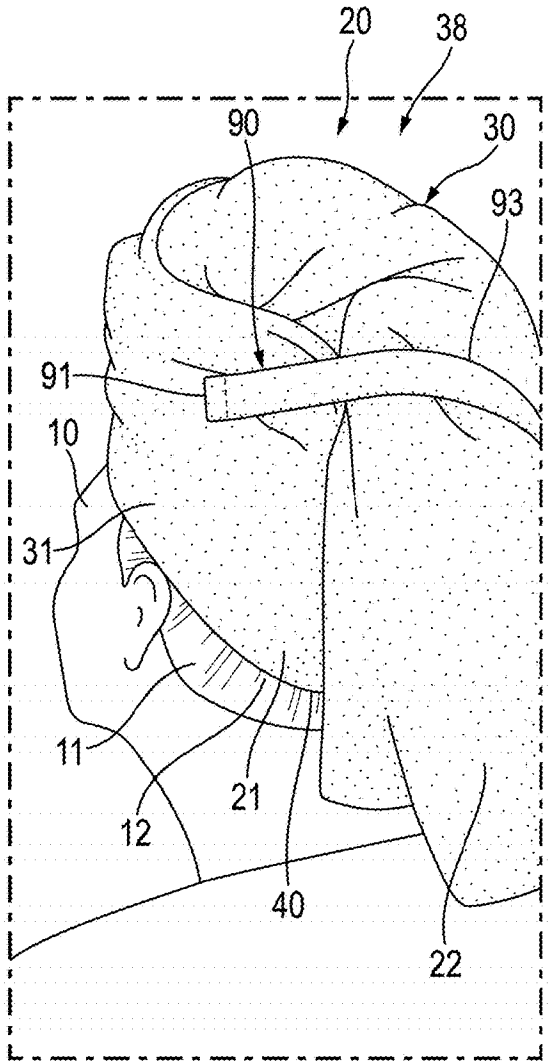
FIG. 2B is a perspective view of the contourable product of FIG. 1A in the wrapped position.
Figure 2A:
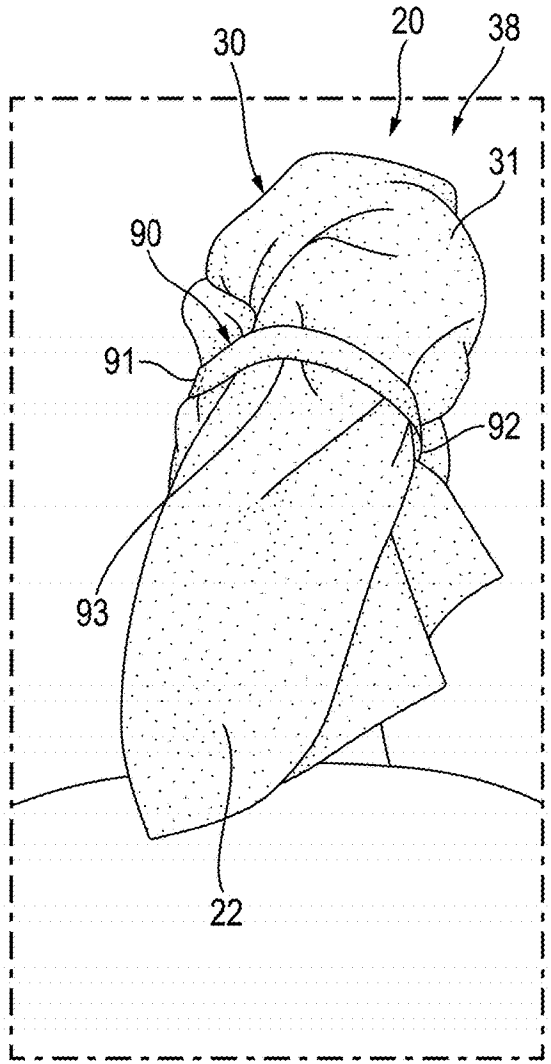
FIG. 2A is a back view of the contourable product of FIG. 1A in a wrapped position.

As shown in FIGS. 2A-2C, in the wrapped position 38, the back edge 40 is configured to extend around and along the back side 12 of the head 10. At least one of the first and second side edges 50, 60 and/or the first and second angled edges 70, 80 (depending on the length of the hair 11 and the size of the head 10 relative to the contourable product 20, for example) are configured to extend along and wrap around at least a portion of the length of the head hair 11.

At least a portion (or all) of the contourable product 20 (e.g., at least the main sheet 30) is constructed out of and includes a flexible, absorbent (e.g., liquid-absorbing) material that is configured to absorb a liquid or moisture. The main sheet 30 may include a single layer or multiple layers of material. The contourable product 20 may be configured to passively and/or actively dry the hair 11. In at least one embodiment, at least a portion (or all) of the contourable product 20 may be constructed out of a material that has a ratio of polyester to polyamide that ranges from about 65:35 to about 80:20, for example. In some embodiments, the ratio may be about 70:30 to about 80:20 or about 60:40 to about 75:25, for example. Such material is sufficiently absorbent to dry the head hair 11 according to at least one embodiment.

According to one embodiment, the contourable product 20 (in particular the main sheet 30) does not include or define any pockets or openings between opposite sides of the main sheet 30 (for example, pockets that are configured to receive a portion of the user's head 10). Accordingly, none of the edges 40, 50, 60, 70, 80, 140, 170, 180 define openings between the first side 31 and the second side 32, and, in the unwrapped position 36 (as shown in FIGS. 1A-1B), the first side 31 and the second side 32 are the topmost and bottommost sides (e.g., the contourable product 20 is not folded over along itself). Although the main sheet 30 may include multiple layers, each of the edges 40, 50, 60, 70, 80, 140, 170, 180 defined a single, main layer of the contourable product 20 that can be completely unfolded into the unwrapped position 36 without any modification to the structure of the contourable product 20 or removing or detachment of any portion thereof.

As shown in FIGS. 1A, 2A-2B, and 3, the contourable product 20 further includes a fastener 90 positioned along the first side 31 and in the first end portion 21 of the main sheet 30. The fastener 90 is configured to receive, retain, and secure the second end portion 22 of the main sheet 30 in the wrapped position 38. The second side 32 of the main sheet 30 is, however, substantially flat in the unwrapped position 36 and does not have any fasteners attached thereto (as shown in FIG. 1B). Although the fastener 90 is shown as a strap or band of material, the fastener 90 may be a variety of different types of fasteners (e.g., a hoop, a loop, a handle, a ring, etc.) configured to secure the second end portion 22 of the main sheet 30.

The fastener 90 may comprise a strip or sheet or material with a first end 91, a second end 92, and a middle portion 93. The first end 91 and the second end 92 are opposite each other along the length of the fastener 90. The fastener 90 is attached to the first side 31 of the main sheet 30 along and at both the first end 91 and the second end 92. The middle portion 93 is positioned between the first end 91 and the second end 92 along the length of the fastener 90. The fastener 90 is not attached to the main sheet 30 along the middle portion 93. Instead, the middle portion 93 and the first side 31 of the main sheet 30 define an area to receive, retain, and secure the second end portion 22 of the main sheet 30. Accordingly, the second end portion 22 of the main sheet 30 is configured to be secured within this area in the wrapped position 38, as shown in FIGS. 2A-2C. According to at least one embodiment, the length of the fastener 90 (i.e., the distance between the first end 91 and the second end 92) may be approximately 6-9 in., for example, 7 in.

The fastener 90 may be constructed out of an elastic material to compress and thereby secure the second end portion 22 within the area between the middle portion 93 of the fastener 90 and the first side 31 of the main sheet 30.

Figure 5:
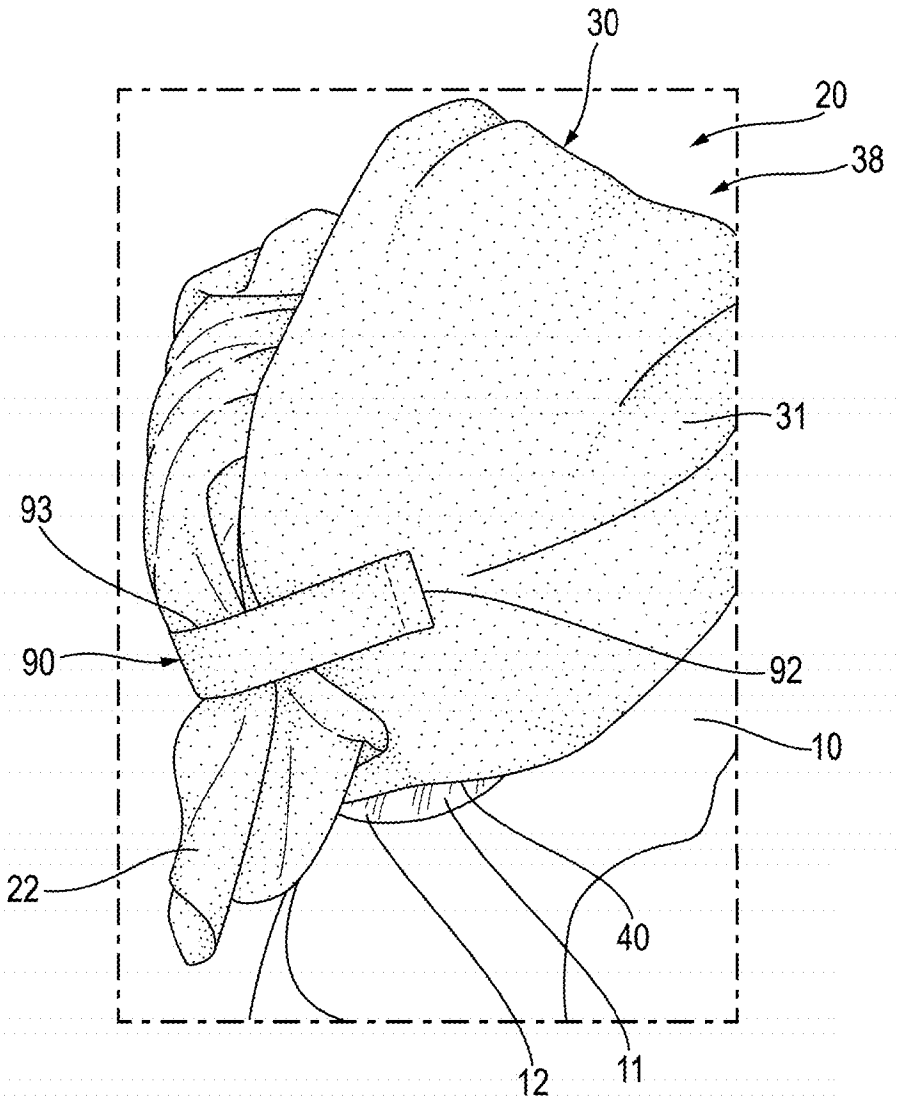
FIG. 5 is a back, side perspective view of the contourable product of FIG. 1A.

As shown in FIG. 1A, the fastener 90 is positioned within the first end portion 21 and along the back edge 40 of the main sheet 30 (and may be relatively close to the back edge 40, such as approximately 2.5 in). Accordingly, in the wrapped position 38, the fastener 90 is positioned anywhere along the back side 12 of the head 10. The fastener 90 may be positioned along a variety of different areas along the back side 12 of the head 10. The position of the fastener 90 along the back side 12 of the head 10 may depend on a variety of different factors, such as the configuration of the contourable product 20 (e.g., the distance between the fastener 90 and the back edge 40), the size of the user's head 10, and the position along which the user places the contourable product 20 on their head 10. For example, as shown in FIG. 2B, the fastener 90 is positioned along a top portion of the back side 12 of the head 10. However, as shown in FIG. 5, the fastener 90 may alternatively be positioned along a bottom portion of the back side 12 (e.g., closer to the base of the skull). The fastener 90 may be extend substantially parallel to the back edge 40 along its length.

Figure 4C:
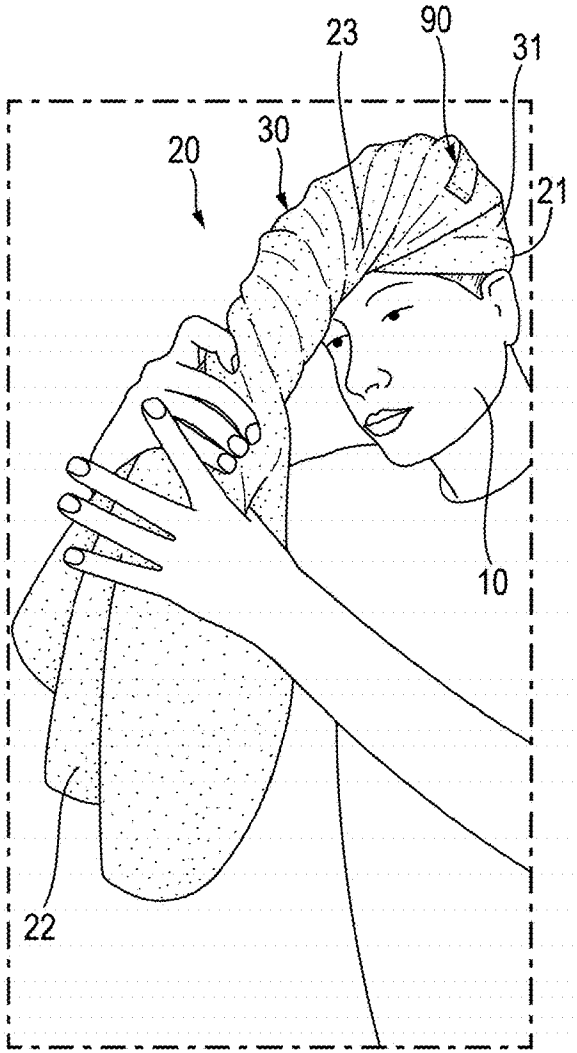
FIGS. 4A-4F are perspective views of the contourable product of FIG. 1A being secured to and wrapping around head hair.
Figure 4B:
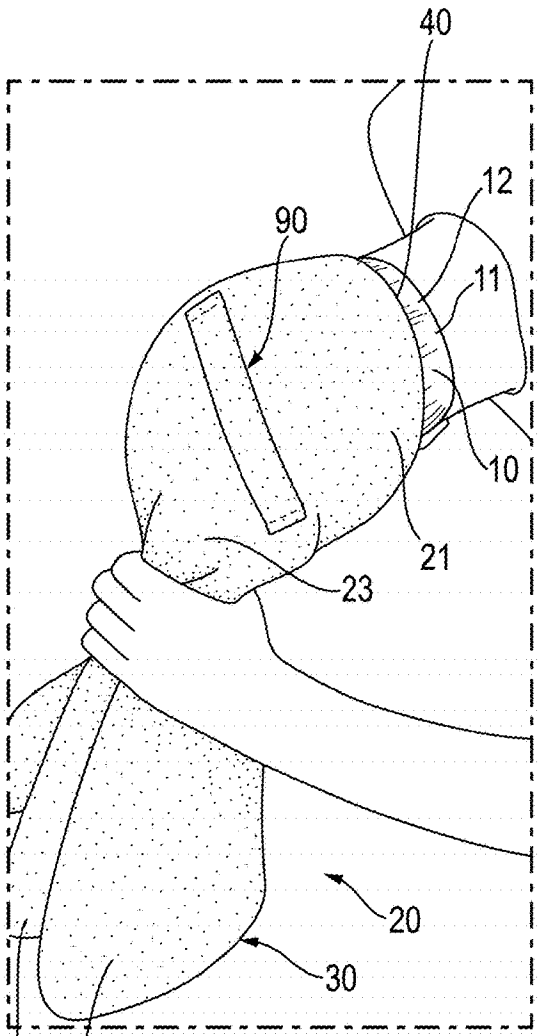
Figure 4A:
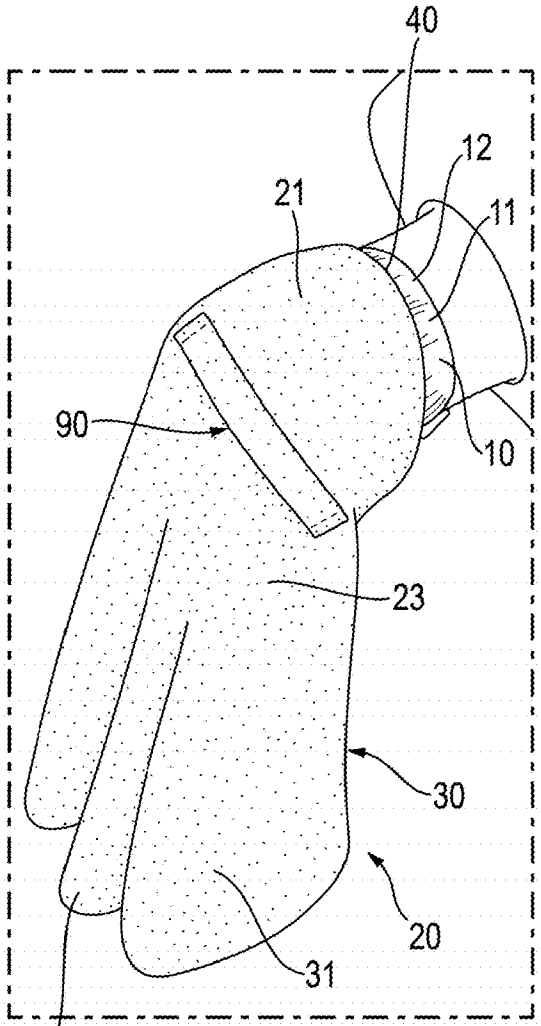

FIGS. 4A-4F show the contourable product 20 being wrapped around and attached to a head 10 of a user to dry the user's head hair 11. First, as shown in FIG. 4A, the user may bend forward to drape their hair 11 backward over the top of their head 10. The contourable product 20 is placed and draped over and around the hair 11 by placing the second side 32 of the main sheet 30 (shown in FIG. 1B) directly on top of and facing the back side 12 of the head 10, with the first side 31 facing away from the head 10. The contourable product 20 is positioned such that the back edge 40 (and thus also the first end portion 21) extends along the lower portion of the back side 12 of the head 10 (e.g., along a top portion of the neck). The second end portion 22 hangs in front of the user's face, draping toward the floor with the rest of the user's hair 11. Since the fastener 90 is positioned in the first end portion 21, the fastener 90 is also positioned along the back side 12 of the head 10. The configuration permits a user to take at least a portion of the outer edges of the main sheet 30 and wrap them around their head (with one over top of the other) and completely around the hanging hair 11, such that opposite outer edges join and overlap each other along a front side of the head 10 (e.g., along the user's forehead).

As shown in FIG. 4B, the user then grasps the middle portion 23 of the main sheet 30 (that is between the first end portion 21 and the second end portion 22) that is directly beyond the user's head 10 (in particular beyond their forehead). By grasping the middle portion 23, the user also grabs all of the hair 11 that is surrounded and enclosed by the middle portion 23. As shown in FIG. 4C, the user then twists this middle portion 23 (as they optionally stand back up), which twists the main sheet 30 around itself and the hair 11. The user continues to twist the main sheet 30 in a directed toward the second end portion 22 along the length of the main sheet 30, until they reach the second end portion 22 and the main sheet 30 is twisted from the head 10 to the end of the second end portion 22 (e.g., to the fifth corner 135).

Figure 3:
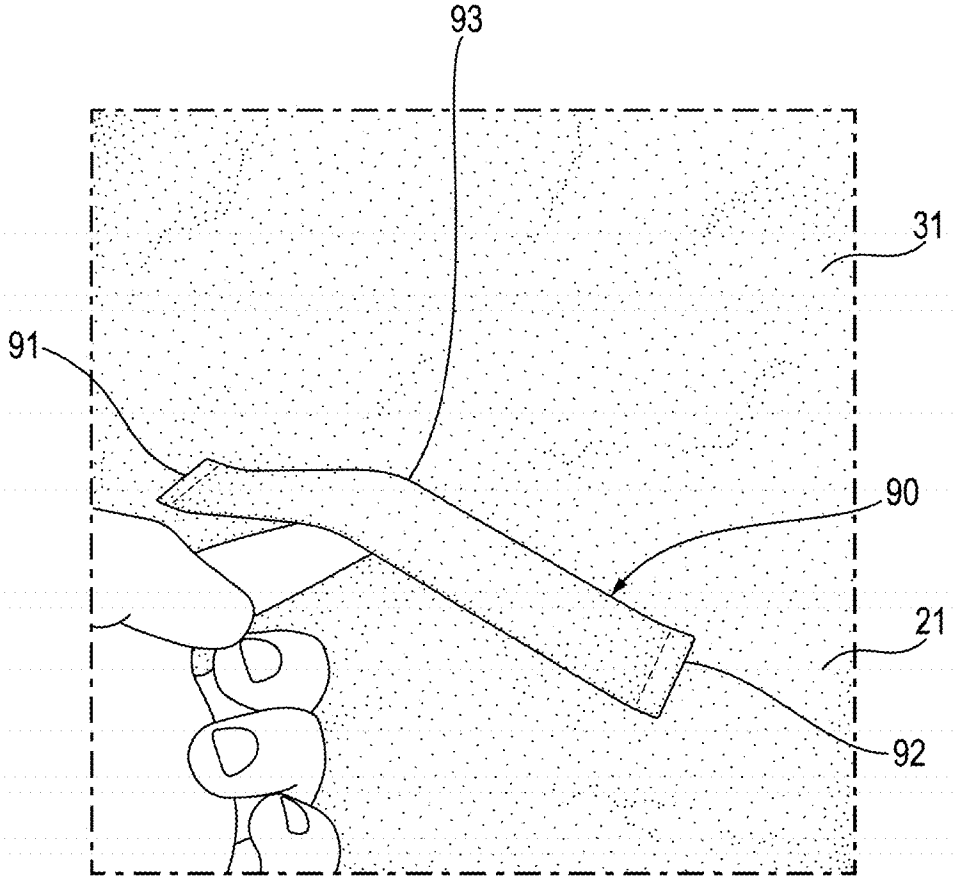
FIG. 3 is a perspective view of a fastener of the contourable product of FIG. 1A.
Figures 4D, 4E, 4F:
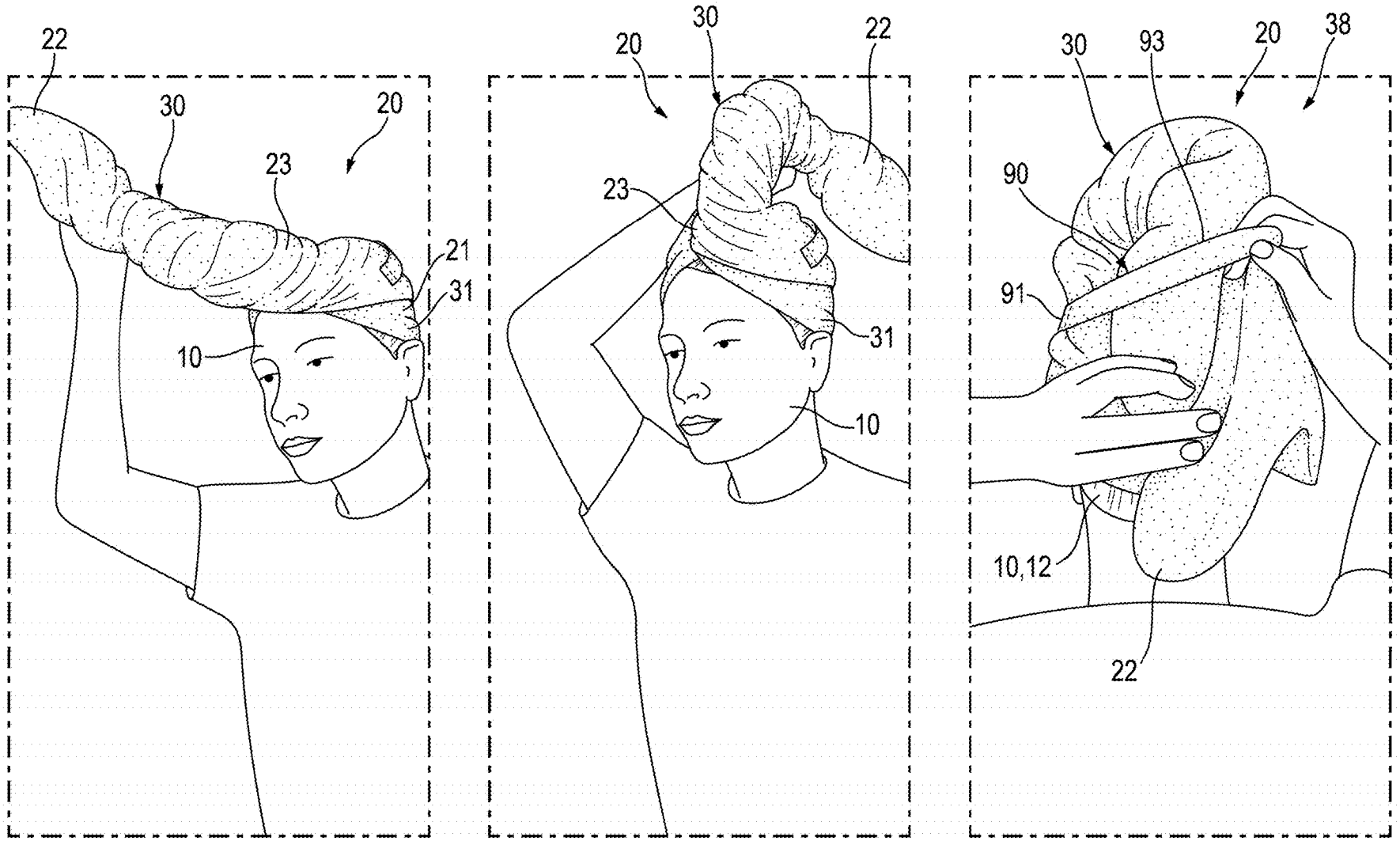

As shown in FIGS. 4D-4E, once the second end portion 22 of the main sheet 30 has been twisted around the hair 11, the user flips the twisted portion (which includes the second end portion 22) from an area in front of their face, over their head 10, to an area behind the back side 12 of their head 10. As shown in FIG. 4F, the user then secures the contourable product 20 into place in the wrapped position 38 by fastening the second end portion 22 to the fasteners 90. In particular, the user tucks the second end portion 22 into the area between the middle portion 93 of the fastener 90 and the first side 31 of the main sheet 30 (as shown in FIG. 3). The elastic compression of the fastener 90 in a direction toward the first side 31 of the main sheet 30 prevents the twisted portion from moving away from the back side 12 of the head 10 or untwisting.

The various embodiment disclose herein (including but not limited to the pentagonal contourable product, the hexagonal contourable product, the heptagonal contourable product, and the octagonal contourable product) may have any of the features, configurations, and aspects of any of the other embodiments disclosed herein, unless otherwise specified.

As utilized herein, the term "approximately," "about," and "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. Unless otherwise indicated, all numbers expressing quantities of properties, parameters, conditions, and so forth, used in the specification and claims are to be understood as being modified in all instances by the term "about." Accordingly, unless indicated to the contrary, the numerical parameters set forth in the following specification and attached claims are approximations. Any numerical parameter should at least be construed in light of the number reported significant digits and by applying ordinary rounding techniques. The term "about" when used before a numerical designation, e.g., temperature, time, amount, and ratios, indicates approximations which may vary by (+) or (−) 10%, 5% or 1%.

The terms "coupled," "connected," "attached," and the like as used herein mean the joining of two members directly to one another. Such joining may be stationary (e.g., permanent) or moveable (e.g., removable or releasable).

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure. For example, in at least one embodiment, the contourable product may be adapted for grooming applications for pets, and may be adapted to fit around a pet head. Further, in some embodiments, a method of drying hair includes disposing the contourable product 20 on the human head, and retaining the contourable product 20 in place via the fastener.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A contourable product for absorbing moisture, the contourable product comprising:

a main sheet comprising an absorbent material, wherein the main sheet is movable between an unwrapped position and a wrapped position, the main sheet comprising a first end portion and a second end portion that are opposite each other along a length of the main sheet, the main sheet comprising a plurality of side edges, a number of the plurality of side edges of the main sheet being more than five, such that the main sheet is defined by a polygonal shape, the plurality of side edges comprising at least a back edge;

a fastener positioned in the first end portion of the main sheet, the fastener positioned along the back edge of the main sheet such that the fastener is positioned along a back side of a human head in the wrapped position, the fastener comprising elastic material and configured to compress the second end portion beneath the fastener and thereby secure the second end portion in place, wherein, in the unwrapped position, the main sheet is completely unfolded and substantially flat, wherein, in the wrapped position, the main sheet is contoured to secure to and wrap around the human head and extend around head hair of the human head, wherein the main sheet is structured so as to have a reduced surface area relative to a rectangle defining the length and a width of the main sheet in the unwrapped position, the rectangle having excess regions formed in a triangular shape and disposed at interior corners of the rectangle, wherein an entire length of the back edge is coextensive with at least a portion of a rectangular edge of the rectangle, wherein, when superimposed on the rectangle in the unwrapped position, material of the main sheet is absent in a plurality of the excess regions, and wherein the main sheet has reduced slack in the wrapped position as compared to a main sheet formed as the rectangle having the plurality of excess regions.

2. The contourable product of claim 1, wherein the polygonal shape is a hexagonal shape which defines the main sheet in the unwrapped position such that distal excess regions are absent.

3. The contourable product of claim 1, wherein the polygonal shape is a heptagonal shape which defines the main sheet in the unwrapped position such that distal excess regions and proximal excess regions are absent.

4. The contourable product of claim 1, wherein the polygonal shape is an octagonal shape which defines the main sheet in the unwrapped position such that distal excess regions and proximal excess regions are absent.

5. The contourable product of claim 1, wherein at least a portion of the main sheet is configured to twist around at least a portion of itself and at least a portion of the human hair in the wrapped position.

6. The contourable product of claim 1, wherein the main sheet comprises a first side and a second side opposite each other, wherein the number of the plurality of side edges of the main sheet is more than six, wherein the plurality of side edges extend about a perimeter of the main sheet and extend between the first side and the second side about the perimeter of the main sheet.

7. The contourable product of claim 1, wherein the plurality of side edges further comprises a first side edge, a second side edge, a first angled edge, and a second angled edge.

8. The contourable product of claim 7, wherein the back edge is substantially perpendicular to the first and second side edges, wherein the first and second angled edges are at oblique angles to the back edge and the first and second side edges.

9. The contourable product of claim 7, wherein the back edge is positioned along an opposite end of the main sheet from the first and second angled edges.

10. The contourable product of claim 7, wherein the back edge extends between a first end of the first side edge and a first end of the second side edge, wherein the first angled edge and the second angled edge together extend between a second end of the first side edge and a second end of the second side edge.

11. The contourable product of claim 10, wherein the first and second angled edges are directly adjacent to each other about a perimeter of the main sheet.

12. The contourable product of claim 7, wherein, in the wrapped position, the back edge is configured to extend around the back side of the human head, at least one of the first or second side edges and at least one of the first or second angled edges are configured to extend along and wrap around at least a portion of the length of the head hair of the human head.

13. The contourable product of claim 7, wherein the first angled edge and the second angled edge form at least a portion of the second end portion of the main sheet, wherein, in the wrapped position, the first end portion is configured to curve substantially parallel to a back side of the human head and the second end portion is configured to twist around itself and at least a portion of the human hair.

14. The contourable product of claim 13, wherein the fastener extends substantially parallel to the back edge.

15. The contourable product of claim 1, wherein the main sheet comprises a first side and a second side opposite each other, further comprising a fastener positioned along the first side that is configured to receive and retain the second end portion of the main sheet in the wrapped position.

16. The contourable product of claim 15, wherein the second side is a substantially flat surface in the unwrapped position and does not have a fastener attached thereto.

17. The contourable product of claim 15, wherein:

the fastener comprises a first end, a second end, and a middle portion positioned between the first end and the second end, wherein the fastener is attached to the first side of the main sheet along the first end and the second end, the fastener is configured to compress the second end portion of the main sheet within an area between the middle portion of the fastener and the first side of the main sheet, and the middle portion consists of a strip of the elastic material.

18. The contourable product of claim 17, wherein the second end portion of the main sheet is configured to be secured within the area between the middle portion of the fastener and the first side of the main sheet, and the fastener consists of the first end, the second end, and the middle portion.

19. The contourable product of claim 15, wherein, in the wrapped position, the second side is configured to extend along and face the human head.

20. The contourable product of claim 1, wherein the main sheet does not comprise a pocket.

21. A method of drying hair comprising:

disposing the contourable product of claim 13 on the human head; and retaining the contourable product in place via the fastener.

* * * * *